US009714114B2

(12) United States Patent
Kittler et al.

(10) Patent No.: US 9,714,114 B2
(45) Date of Patent: Jul. 25, 2017

(54) FULL APERTURE CAN END

(71) Applicant: Crown Packaging Technology, Inc., Alsip, IL (US)

(72) Inventors: Michael Patrick Kittler, Plainfield, IL (US); Garry Richard Chant, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 657 days.

(21) Appl. No.: 14/075,299

(22) Filed: Nov. 8, 2013

(65) Prior Publication Data

US 2015/0129595 A1 May 14, 2015

(51) Int. Cl.
*B65D 17/00* (2006.01)
*B65D 41/00* (2006.01)

(52) U.S. Cl.
CPC ..... *B65D 17/165* (2013.01); *B65D 17/163* (2013.01); *B65D 41/005* (2013.01); *B65D 2517/0092* (2013.01)

(58) Field of Classification Search
CPC ..... B65D 17/163165; B65D 24/00; B65D 51/1672; B65D 2517/0016; B65D 2517/009; B67B 7/00
USPC ..... 220/269–273, 906; 53/492; 413/56, 67, 413/69; 222/478–479, 481, 481.5, 541.9; D9/435, 438
See application file for complete search history.

(56) References Cited

U.S. PATENT DOCUMENTS

| | | | |
|---|---|---|---|
| D30,094 | S | 1/1899 | Busch |
| D30,338 | S | 3/1899 | Mann |
| 2,683,579 | A | 7/1954 | Wallace |
| 3,301,464 | A | 1/1967 | Amberg |
| D207,051 | S | 2/1967 | Bainbridge |
| 3,406,866 | A | 10/1968 | Jasper |
| 3,477,608 | A | 11/1969 | Fraze |
| 3,485,410 | A | 12/1969 | Boik |
| 3,701,330 | A | 10/1972 | Kinkel |

(Continued)

FOREIGN PATENT DOCUMENTS

| | | |
|---|---|---|
| AU | 147710 | 5/2002 |
| CH | 527102 | 8/1972 |

(Continued)

OTHER PUBLICATIONS

"Nuts About Cans!", Rexam PLC, Beverage Packaging: Product News, Apr. 2005, 2 pages.

(Continued)

*Primary Examiner* — J. Gregory Pickett
*Assistant Examiner* — Brijesh V. Patel
(74) *Attorney, Agent, or Firm* — Baker & Hostetler LLP

(57) ABSTRACT

A full aperture unseamed can end having a vent test rating of at least 90 psi comprising a center panel having an periphery and including a coined portion proximate a rivet, a first score defining a removable panel, a tab, including a nose, mounted to of the removable panel, and a second score disposed on the removable panel, the second score having (i) a central portion spaced apart from the coined portion; (ii) a pair of check slots disposed on either side of the central portion; (iii) a pair of lateral portions that extend from the check slots; and (iv) a pair of side portions that extend from the lateral portions, respectively.

27 Claims, 7 Drawing Sheets

(56) References Cited

U.S. PATENT DOCUMENTS

| | | | | |
|---|---|---|---|---|
| 3,951,299 | A | 4/1976 | Khoury | |
| 3,977,561 | A | 8/1976 | Strobe et al. | |
| 4,002,262 | A | 1/1977 | Khoury | |
| 4,014,455 | A | 3/1977 | LaCroce | |
| 4,042,144 | A * | 8/1977 | Henning | B65D 17/163 220/273 |
| 4,096,967 | A | 6/1978 | Kaminski | |
| 4,182,460 | A | 1/1980 | Holk, Jr. et al. | |
| RE30,349 | E | 7/1980 | Silver | |
| 4,271,778 | A | 6/1981 | Le Bret | |
| D265,280 | S | 7/1982 | Conti | |
| 4,386,713 | A * | 6/1983 | Baumeyer | B65D 17/163 220/269 |
| 4,416,390 | A * | 11/1983 | Takeda | B65D 17/165 220/273 |
| 4,503,989 | A * | 3/1985 | Brown | B21D 51/383 220/269 |
| D286,508 | S | 11/1986 | Tilden | |
| 4,809,861 | A | 3/1989 | Wilkinson et al. | |
| 4,930,658 | A | 6/1990 | McEldowney | |
| 5,052,573 | A | 10/1991 | Zysset | |
| D328,864 | S | 8/1992 | Grunzweig | |
| 5,232,114 | A | 8/1993 | Zysset | |
| 5,356,256 | A | 10/1994 | Turner et al. | |
| D356,456 | S | 3/1995 | Henry | |
| D358,988 | S | 6/1995 | Nolte | |
| 5,582,319 | A | 12/1996 | Heyes et al. | |
| D379,588 | S | 6/1997 | Pledger et al. | |
| 5,645,190 | A | 7/1997 | Goldberg | |
| 5,711,448 | A | 1/1998 | Clarke, III | |
| 5,860,553 | A | 1/1999 | Schubert | |
| D406,236 | S | 3/1999 | Brifcani et al. | |
| 5,911,551 | A | 6/1999 | Maran | |
| 5,934,498 | A | 8/1999 | Jordan | |
| 5,957,647 | A | 9/1999 | Hinton | |
| 5,971,259 | A | 10/1999 | Bacon | |
| 6,065,634 | A | 5/2000 | Brifcani et al. | |
| 6,089,072 | A | 7/2000 | Fields | |
| D431,413 | S | 10/2000 | Schaper et al. | |
| D480,304 | S | 10/2003 | Stodd | |
| D488,376 | S | 4/2004 | Chung | |
| 6,715,629 | B2 | 4/2004 | Hartman et al. | |
| D489,611 | S | 5/2004 | Monsanty | |
| 6,848,875 | B2 | 2/2005 | Brifcani et al. | |
| 6,915,553 | B2 | 7/2005 | Turner et al. | |
| D515,353 | S | 2/2006 | Martin | |
| D525,127 | S | 7/2006 | Cogley et al. | |
| 7,100,789 | B2 | 9/2006 | Nguyen et al. | |
| D558,825 | S | 1/2008 | Masters | |
| D559,680 | S | 1/2008 | Jacober et al. | |
| 7,341,163 | B2 | 3/2008 | Stodd | |
| D567,657 | S | 4/2008 | Hall et al. | |
| D570,213 | S | 6/2008 | Newman | |
| D588,936 | S | 3/2009 | Ioannids et al. | |
| 7,500,376 | B2 | 3/2009 | Bathurst et al. | |
| 7,506,779 | B2 | 3/2009 | Jentzsch et al. | |
| D591,149 | S | 4/2009 | Bonner et al. | |
| 7,673,768 | B2 | 3/2010 | Reed et al. | |
| 7,743,635 | B2 | 6/2010 | Jentzsch et al. | |
| 7,922,025 | B2 | 4/2011 | Heinicke | |
| D641,239 | S | 7/2011 | Ramsey et al. | |
| D641,622 | S | 7/2011 | Fields | |
| D641,623 | S | 7/2011 | Fields | |
| D643,718 | S | 8/2011 | Fields | |
| D647,400 | S | 10/2011 | Fields | |
| D649,049 | S | 11/2011 | Fields | |
| 8,047,754 | B2 * | 11/2011 | Heinicke | B21D 51/383 220/265 |
| 8,109,405 | B2 * | 2/2012 | Butcher | B21D 51/383 220/271 |
| 8,939,308 | B2 | 1/2015 | Ramsey | |
| 2003/0121920 | A1 | 7/2003 | Zonker et al. | |
| 2004/0026433 | A1 | 2/2004 | Brifcani et al. | |
| 2004/0076721 | A1 | 4/2004 | Rosenfeld et al. | |
| 2005/0284869 | A1 | 12/2005 | Mills | |
| 2007/0029324 | A1 | 2/2007 | Watson et al. | |
| 2008/0067171 | A1 | 3/2008 | Heinicke | |
| 2008/0078764 | A1 * | 4/2008 | McEldowney | B65D 17/165 220/269 |
| 2010/0059530 | A1 | 3/2010 | Niec et al. | |
| 2010/0166528 | A1 * | 7/2010 | McEldowney | B21D 51/383 413/16 |
| 2011/0056945 | A1 | 3/2011 | Ramsey | |
| 2011/0186575 | A1 * | 8/2011 | Dunwoody | B65D 17/163 220/270 |
| 2011/0303672 | A1 | 12/2011 | Fields | |
| 2013/0075401 | A1 * | 3/2013 | Forrest | B21D 51/383 220/270 |

FOREIGN PATENT DOCUMENTS

| | | |
|---|---|---|
| EP | 0737624 | 10/1996 |
| EP | 1577222 | 9/2005 |
| EP | 1813540 | 8/2007 |
| EP | 2070826 | 6/2009 |
| EP | 09169559.3 | 9/2009 |
| GB | 1358427 | 7/1974 |
| GB | 1453131 | 10/1976 |
| GB | 2168313 | 6/1986 |
| JP | 47-22064 | 11/1972 |
| JP | S58-109922 | 7/1983 |
| JP | 59-133439 | 9/1984 |
| JP | S59-209533 | 11/1984 |
| JP | 2000-128168 | 5/2000 |
| RU | 2278062 C2 | 6/2006 |
| WO | WO 03/068615 | 8/2003 |
| WO | WO 2009/002715 | 12/2008 |
| WO | WO 2010/020375 | 2/2010 |
| WO | WO 2011/026900 A1 | 3/2011 |
| WO | WO 2013/172783 A1 | 11/2013 |

OTHER PUBLICATIONS

Ball Packaging Europe, "Full aperture tear-off end", http://www.balleuroQe. corn/382 349ENG PHP.htrnl, accessed Dec. 2, 2010, 1 page.

Colombian Design Application No. 10-155603, Rejection Resolution No. 71192, Issued on Dec. 15, 2011, 7 pages.

Colombian Design Application No. 10-155603, Rejection Resolution No. 71192, Issued on Dec. 15, 2011, 3 pages (English Translation).

English translation of Japanese Patent Application No. 2012-527320: Notification of Reason for Rejection dated Apr. 2, 2014, 3 pages.

Fanta Redesigns Their Visual Identity, @blogdovborges dated Sep. 30, 2008, http://vborges.net/vblog/2008/09/30/fanta-redesenha-sua-identidade-visual- , 13 pages, Access date Dec. 15, 2011.

Opinions on Corporate and Brand Identity Work, "Brand New: The Real Thing. Really.", By JonSel, http://www.underconsideration.com/brandnew/archives/the.sub.--real.sub.---thing.php, 38 pages, Access date Dec. 15, 2011.

Packaging Creative Treatment, http://creativetreatment.wordpress.com/category/packaging/page/3/, 12 pages, Access date Dec. 15, 2011.

U.S. Appl. No. 29/363,492: Notice of Allowance dated Dec. 1, 2010, 7 pages.

U.S. Appl. No. 29/363,498: Notice of Allowance dated Nov. 29, 2010, 6 pages.

U.S. Appl. No. 29/363,500: Notice of Allowance dated Nov. 30, 2010, 6 pages.

U.S. Appl. No. 29/368,323: Notice of Allowance dated Dec. 3, 2010, 6 pages.

* cited by examiner

FULL APERTURE CAN END

TECHNICAL FIELD

This invention relates to containers, and more particularly to the can ends and cans that have full aperture openings and are configured for use in high pressure applications, such as containing soda and other carbonated beverages.

BACKGROUND

Conventional beverage can bodies typically are produced in large quantities by a drawing and ironing process. Conventional beverage can ends are formed in a press and then attached to the can body by a double seam.

Internal pressure in beverage cans may subject the scores on the ends of these cans to high forces upon tab actuation and the subsequent formation of cracks in the scores. In some circumstances, high internal pressures can cause sudden, unsafe score rupture or panel failure (for example, missiling) upon opening.

To achieve safe venting in conventional pressurized beverage cans with openings that have an area that is less than a majority of the center panel (such as on conventional 12 ounce beverage cans), can makers typically employ a feature that pauses the propagation of a single score line that defines the perimeter of the opening. Single score lines for beverage cans usually have a check slot to pause score propagation. A check slot is a score residual (that is, the metal at the bottom of the score) that is thicker than other portions of the score. Because the score residual is thicker, the check slot inhibits propagation of the score rupture so that a portion of the internal pressure vents before the remainder of the score is ruptured. In this way, for conventional beverage ends, check slots slow or pause score propagation to provide adequate venting early in the opening process.

Beverage cans with openings that have areas greater than a majority of the center panel, such as full aperture ends, are also known. U.S. Pat. No. 7,922,025 (Heinicke) is directed to venting cans having internal pressure of 25 psi or above, as sometimes found in packaging for nuts and other food items, tennis balls, and the like. Similarly, United States Publication Nos. 2011/0056945A1 ("Ramsey") and 2011/0303672A1 ("Fields") disclose venting cans having internal pressure of greater than 70 psi. However, the structure taught in Heinicke is not suitable for very high pressure applications, such as soft drink cans. Further, the ends disclosed in Ramsey and Fields have not yet been widely commercially adopted. There is a need for improved robustness of soft drink cans, which typically have vent test ratings of at least 90 psi.

Conventional thinking for venting full aperture can ends has been to control, especially by temporarily inhibiting or slowing, score rupture propagation by features that mechanically arrest the score rupture, increasing score residual in food can ends, and the break line scores in Heinicke. The Ramsey and Fields applications contradicted this thinking by teaching that a vent score that does not have an arresting mechanism will rupture more quickly, such that an opening having sufficient area created by such a vent score releases high internal pressures in the can before those pressures have the opportunity to tear the can end. In this regard, the venting referred to in this application is venting internal beverage can pressure upon opening, as distinguished from a vent that is opened after internal pressure has been released and that has the purpose of improving pouring.

SUMMARY

The present invention discloses a novel way of venting high pressure beverage cans with full aperture ends. While prior art such as Heinicke discloses control mechanisms to minimize tearing in the can end, and the newer Ramsey and Fields references teach avoidance of control mechanisms, the claimed invention steps away from these known concepts. Specifically, the claimed invention employs a unique geometry in terms of the proximity of a central portion of the vent score to the can rivet that provides for vent test ratings above 90 psi.

Despite the long-felt need in the industry to have full aperture soda cans, full aperture ends have not been commercially successful. The inventors uniquely discovered that a small change in the vent score geometry shown in Fields would result in a vent test rating that is 8 psi. greater than those known in the prior art.

A full aperture can assembly having a vent test rating of at least 90 psi comprises a can body and a can end that is attached to the can body by a seam. The can end includes a center panel having an periphery and including a coined portion proximate a rivet, a first score disposed proximate the periphery of the center panel, the first score defining a removable panel, a tab, including a nose, mounted to the removable panel by the rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion spaced apart from the coined portion that intersects the longitudinal axis; (ii) a pair of check slots disposed on either side of the central portion; (iii) a pair of lateral portions that extend from the check slots, respectively, and each include a segment that is approximately parallel to the lateral axis; and (iv) a pair of side portions that extend from the lateral portions, respectively, away from the lateral axis.

A full aperture unseamed can end having a vent test rating of at least 90 psi comprises a peripheral curl capable of seaming together with a can body flange, a wall extending inwardly and downwardly from the peripheral curl, a center panel having an periphery and including a coined portion proximate a rivet, a first score disposed proximate the periphery of the center panel, the first score defining a removable panel, a tab, including a nose, mounted to of the removable panel by the rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion spaced apart from the coined portion that intersects the longitudinal axis; (ii) a pair of check slots disposed on either side of the central portion; (iii) a pair of lateral portions that extend from the check slots, respectively, and each include a segment that is approximately parallel to the lateral axis; and (iv) a pair of side portions that extend from the lateral portions, respectively, away from the lateral axis.

A full aperture can assembly having a vent test rating of at least 90 psi comprises a can body and a can end that is attached to the can body by a seam. The can end includes a center panel having an periphery, a first score disposed proximate the periphery of the center panel, the first score defining a removable panel, a tab, including a nose, mounted the removable panel by a rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion defined by a radius extending from the center of the rivet, the radius having a value of at least 0.140 inches, the central portion intersecting the longitudinal axis; (ii) a pair of check slots disposed on either side of the central portion; (iii) a pair of lateral portions that extend from the check slots, respectively, and each include a segment that is approximately parallel to the lateral axis; and (iv) a pair of side portions that extend from the lateral portions, respectively, away from the lateral axis.

A full aperture unseamed can end having a vent test rating of at least 90 psi comprises a peripheral curl capable of seaming together with a can body flange, a wall extending inwardly and downwardly from the peripheral curl, a center panel having a periphery, a first score disposed proximate the periphery of the center panel, the first score defining a removable panel, a tab, including a nose, mounted to the removable panel by a rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion defined by a radius extending from the center of the rivet, the radius having a value of at least 0.140 inches, the central portion intersecting the longitudinal axis; (ii) a pair of check slots disposed on either side of the central portion; (iii) a pair of lateral portions that extend from the check slots, respectively, and each include a segment that is approximately parallel to the lateral axis; and (iv) a pair of side portions that extend from the lateral portions, respectively, away from the lateral axis.

A full aperture can assembly having a vent test rating of at least 90 psi comprises a can body and a can end that is attached to the can body by a seam. The can end includes a center panel having a periphery and including a coined portion proximate a rivet, a first score disposed proximate the periphery of the center panel, the first score defining a removable panel, a tab, including a nose, mounted to the removable panel by the rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion spaced apart from the coined portion that intersects the longitudinal axis; (ii) a pair of lateral portions that each include a segment that is approximately parallel to the lateral axis; and (iii) a pair of side portions that extend from the lateral portions, respectively, away from the lateral axis.

A full aperture unseamed can end having a vent test rating of at least 90 psi comprises a peripheral curl capable of seaming together with a can body flange, a wall extending inwardly and downwardly from the peripheral curl, a center panel having a periphery and including a coined portion proximate a rivet, a first score disposed proximate the periphery of the center panel, the first score defining a removable panel, a tab, including a nose, mounted the removable panel by the rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion spaced apart from coined portion that intersects the longitudinal axis; (ii) a pair of lateral portions that each include a segment that is approximately parallel to the lateral axis; and (iii) a pair of side portions that extend from the lateral portions, respectively, away from the lateral axis.

A full aperture can assembly having a vent test rating of at least 90 psi comprises a can body and a can end that is attached to the can body by a seam. The can end includes a center panel having a periphery, a first score disposed proximate the periphery of the center panel, the first score defining a removable panel, a tab, including a nose, mounted to the removable panel by a rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion defined by a radius extending from the center of the rivet, the radius having a value of at least 0.140 inches, the central portion intersecting the longitudinal axis; (ii) a pair of lateral portions that each include a segment that is approximately parallel to the lateral axis; and (iii) a pair of side portions that extend from the lateral portions, respectively, away from the lateral axis.

An unseamed can end having a vent test rating of at least 90 psi comprises a peripheral curl capable of seaming together with a can body flange, a wall extending inwardly and downwardly from the peripheral curl, a center panel having a periphery, a first score disposed proximate the periphery of the center panel, the first score defining a removable panel, a tab, including a nose, mounted to the removable panel by a rivet such that the nose is disposed proximate the first score, the tab being elongate along a longitudinal axis that extends through a center of the rivet, the longitudinal axis being perpendicular to a lateral axis that also extends through the center of the rivet, and a second score disposed on the removable panel, the second score having (i) a central portion defined by a radius extending from the center of the rivet, the radius having a value of at least 0.140 inches, the central portion intersecting the longitudinal axis; (ii) a pair of lateral portions that each include a segment that is approximately parallel to the lateral axis; and (iii) a pair of side portions that extend from the lateral portions, respectively, away from the lateral axis.

DETAILED DESCRIPTION OF INVENTION

Figure 1:
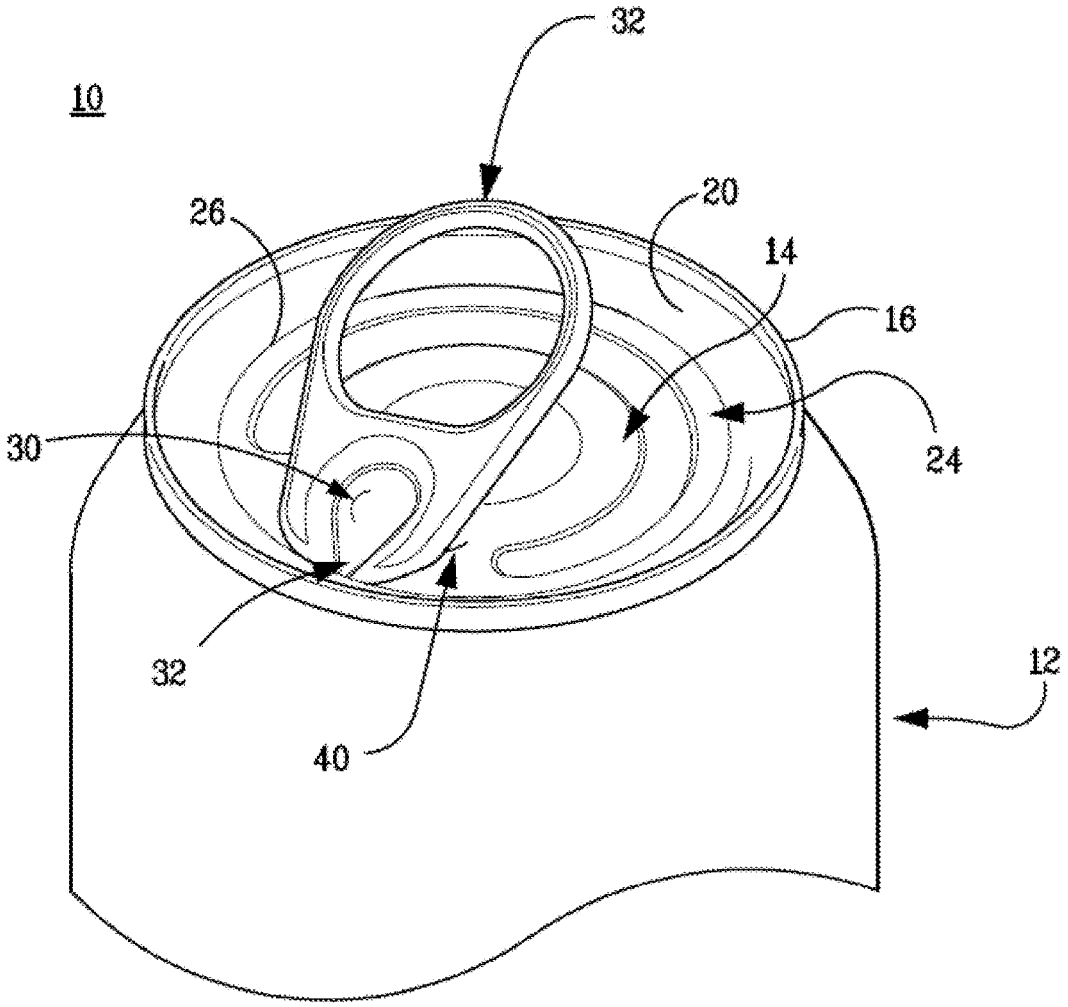
FIG. 1 is a perspective view of a beverage can illustrating an embodiment of the full aperture end of the present invention, in which the tab is in an early stage of its actuation.

As illustrated in FIGS. 1 through 6, a can assembly 10 includes a can body 12 and an end 14. Body 12 and end 14 are joined together by a seam, preferably a conventional double seam 16. Preferably, body 12 is a conventional drawn and ironed 12 ounce or 330 ml beverage can body that is formed from a single piece of aluminum. Alternative embodiments may have bodies of different sizes, for example, 16 ounce, 20 ounce, and 32 ounce sizes and the metric volume equivalents. The can ends 14 may be of the type that is typically produced in commercial quantities. The inventors surmise that can ends 14 would likely be produced in a shell press operating at greater than 300 strokes per minute.

Figure 4:
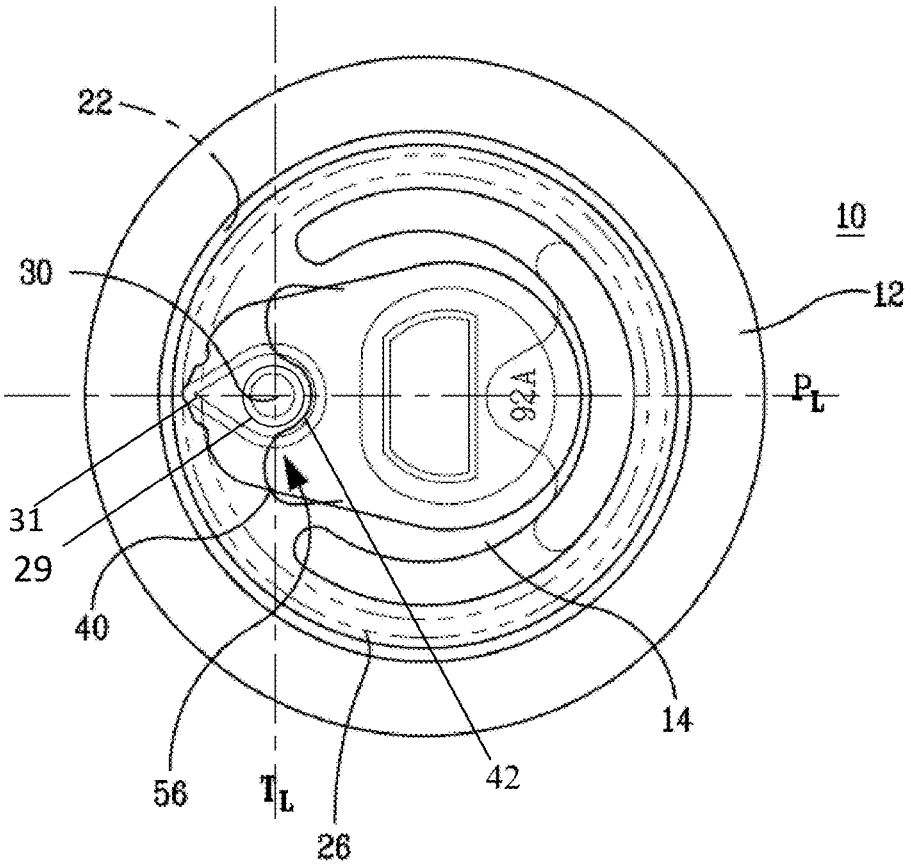
FIG. 4 is a top view of the can of FIG. 1, with the tab shown as transparent to illustrate the vent score.
Figure 5:
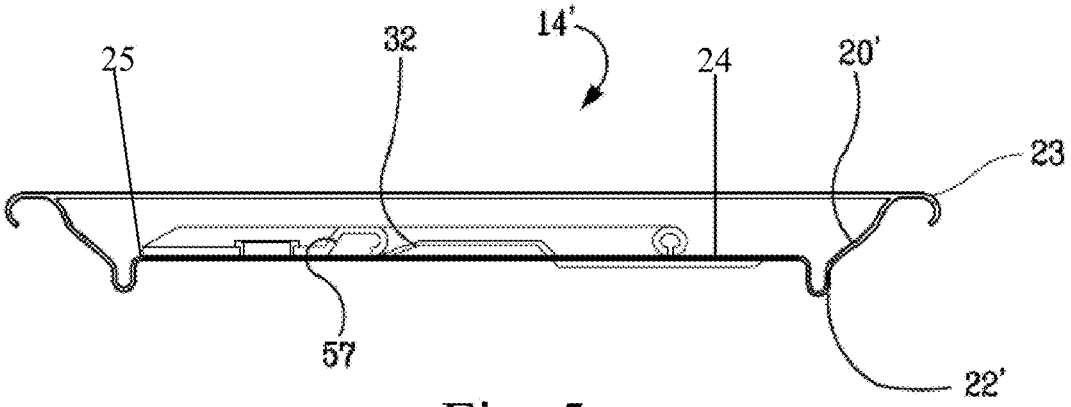
FIG. 5 is a cross sectional view of the end showing its peripheral curl in its configuration before seaming on to a can body.

In its unseamed state shown in FIG. 5, end 14 includes a peripheral curl 23, a wall 20, a countersink 22, and a center panel 24. As best shown in FIGS. 1-4, in its seamed state, peripheral curl has been manipulated to form a part of seam 16. The end preferably is a 200, 202, 204, or 206 size, although the present invention encompasses any size of end. The present invention also encompasses any configuration of wall 20 and countersink 22. Wall configurations may include conventional B64 walls, inclined chuck walls, curved chuck walls, multipart chuck walls, chuck walls with features such as shelves, kicks, kinks, etc., and the like. Countersink configurations may include countersinks with straight sidewalls, curved sidewalls, narrow beads, broad beads, folded or pinched beads, and the like. The configurations of the ends, walls, and countersinks contemplated by the present invention include those marketed or disclosed by Crown Cork & Seal Co., Ball Corp., Metal Container Corp. Container Development Ltd., Rexam Ltd., and Can Pack.

Further, the present invention is illustrated on a beverage can end that is preferably formed from a 5000 series aluminum alloy. Specifically, 5000 series aluminum alloy used for can end making has a tensile yield strength of 39-55 ksi. This tensile yield strength range is adequately high for the given internal pressure of the can given a standard diameter end. This tensile yield strength range is also associated with a relatively greater tendency to tear at the end of the scores with respect to softer metals. The present invention is not limited to this particular alloy but rather encompasses steel, such as tin plate, other grades of aluminum, and the like, unless stated in the claims.

Center panel 24 of the can end 14 is circular and has a periphery 25 adjacent countersink 22. The can end 14 further includes a first score 26 disposed proximate the periphery 25 of the center panel. First score 26 is continuous so as to form a removable panel 34. A tab 32, including a nose 31, is affixed to the removable panel 34 of center panel 24 by rivet 30, such that the nose 31 is disposed proximate the first score 26. A button coin 29 is formed on the center panel 24 around rivet 30 when tab 32 is riveted to the center panel 24. Button coin 29 is defined by the coined portion of the center panel 24 that forms during the riveting process.

To aid in the description of center panel 24, primary or center reference axis line $P_L$ is defined as extending through the center of rivet 30 and through the longitudinal centerline of tab 32 (FIG. 4). Tab 32 is elongate along line $P_L$. For the vast majority of commercial tabs, and as shown in the figures, primary reference line $P_L$ will extend through the point of initial contact between the nose of tab 32 and its point of initial contact on the center panel. Transverse reference axis or line $T_L$ is defined as extending through the center of rivet 30 and perpendicular to the primary reference line $P_L$. The plane defined by lines $P_L$ and $T_L$ is parallel to the plane defined by the top of the seam and parallel to center panel 24, to the extent that center panel 24 defines a plane in its seamed or unseamed state. Transverse reference line $T_L$ divides can end 14 into a front portion on the side of the tab nose and a rear portion on the side of the tab heel.

Vent score 40 includes a central portion 42 that intersects line $P_L$, a pair of check slots 45*a* and 45*b* (FIG. 6) disposed on either side of line $P_L$ about the central portion 42, a pair of lateral portions 46*a* and 46*b* that extend from the check slots 45*a* and 45*b*, each of lateral portions 46*a* and 46*b* including a segment 47*a*, 47*b* that is approximately parallel to the lateral axis and a pair of side portions 50*a* and 50*b* that extend from the lateral portions 46*a* and 46*b*, respectively, away from line $T_L$.

As best shown in FIG. 4, central portion 42 of vent score 40 has a rounded segment that extends around the rivet 30 (where $P_L$ and $T_L$ intersect) spaced apart from button coin 29. Central portion 42 may be at least partially defined by a radius 0.140 inches, or alternatively a radius of at least 0.140 inches, that extends from the center of the rivet 30. Alternatively, central portion 42 may be at least partially defined by a radius in the range of 0.132-0.150 inches. For example, the central portion 42 may be at least partially defined by a radius of 0.132, 0.133, 0.134, 0.135, 0.136, 0.137, 0.138, 0.139, 0.140, 0.141, 0.142, 0.143, 0.144, 0.145, 0.146, 0.147, 0.148, 0.149, 0.150, or a range of radii encompassed by at least two of the radii recited herein. Central portion 42 extends from a point of intersection with $P_L$ forward while extending around rivet 30 to approximately 3 o'clock and 9 o'clock. The radius dimension may be chosen according to known parameters, such as center panel thickness, score thickness, check slot thickness, material choice, and like parameters based on the disclosure in this specification.

In the embodiment shown in the figures, check slots 45*a*, 45*b* extend from the central portion 42 and have a groove that is more shallow than the central portion such that the metal in the area of the check slots 45*a*, 45*b* is thicker relative to the metal in the central portion 42. Each of the check slots 45*a*, 45*b* yields to corresponding inner ends of lateral portions 46*a* and 46*b* through transitions 44*a* and 44*b*. Lateral portions 46*a* and 46*b* extend generally laterally (that is, generally parallel to transverse reference line $T_L$) and outwardly relative to rivet 30. Side portions 50*a* and 50*b* extend generally rearward from outer ends of lateral portions 46*a* and 46*b* through transitions 48*a* and 48*b*. Side portions 50*a* and 50*b* end at terminations 52*a* and 52*b*. The vent score terminations may be curved, curled, or angled relative to the side portions of the vent score, or they may simply be the ends of straight side walls, as shown in the figures.

In other embodiments, vent score 40 does not have check slots. Although vent score 40 has similar dimensions to embodiments with check slots, when no check slot is used, central portion 42 extends directly to transitions 44*a* and 44*b*. Lateral portions 46*a* and 46*b* extend from the transitions 44*a* and 44*b* through transitions 48*a* and 48*b*. Side portions 50*a* and 50*b* end at terminations 52*a* and 52*b*.

Figure 6:
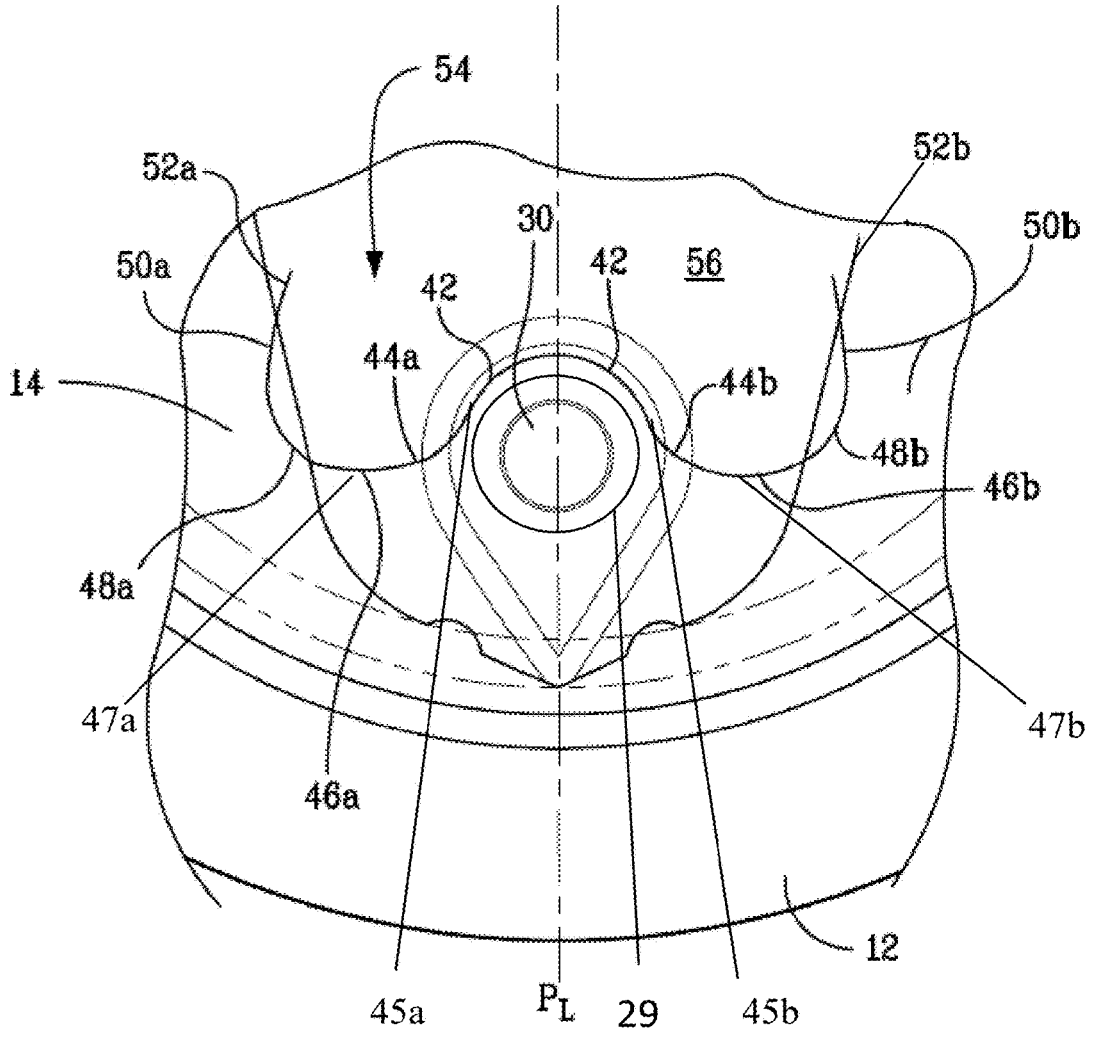
FIG. 6 is an enlarged view of a portion of FIG. 4.
Figure 7:
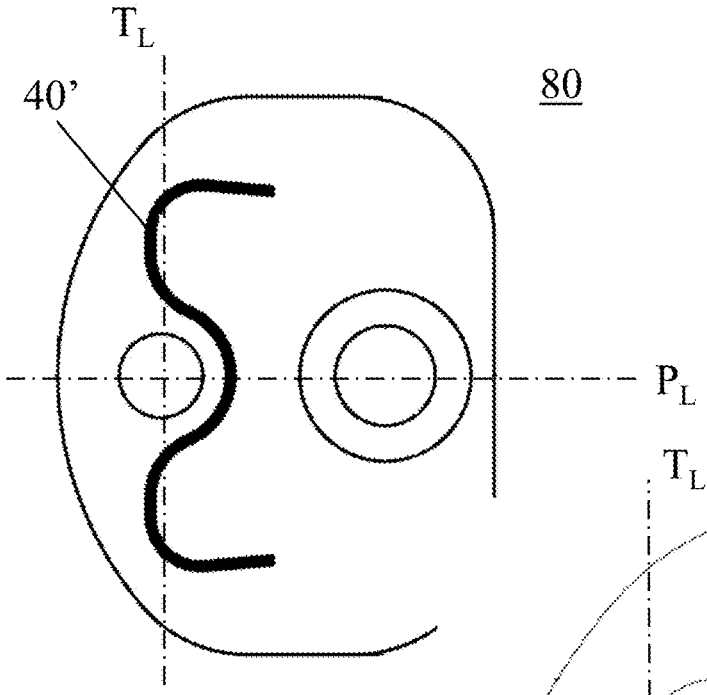
FIG. 7 is a top view of a punch for forming the vent score shown in FIGS. 4 and 6.

As shown in FIG. 6, a hinge 54 is formed on the removable panel 34 between terminations 52*a* and 52*b* of side portions 50*a* and 50*b*. A flap 56 is defined by vent score 40 and hinge 54. A front portion of flap 56 is defined by side portions 50*a* and 50*b*. Sides of flap 56 are defined by side portions 50*a* and 50*b*. The rear of flap 56 is formed (with less specificity in its location) by hinge 54.

Figure 8:
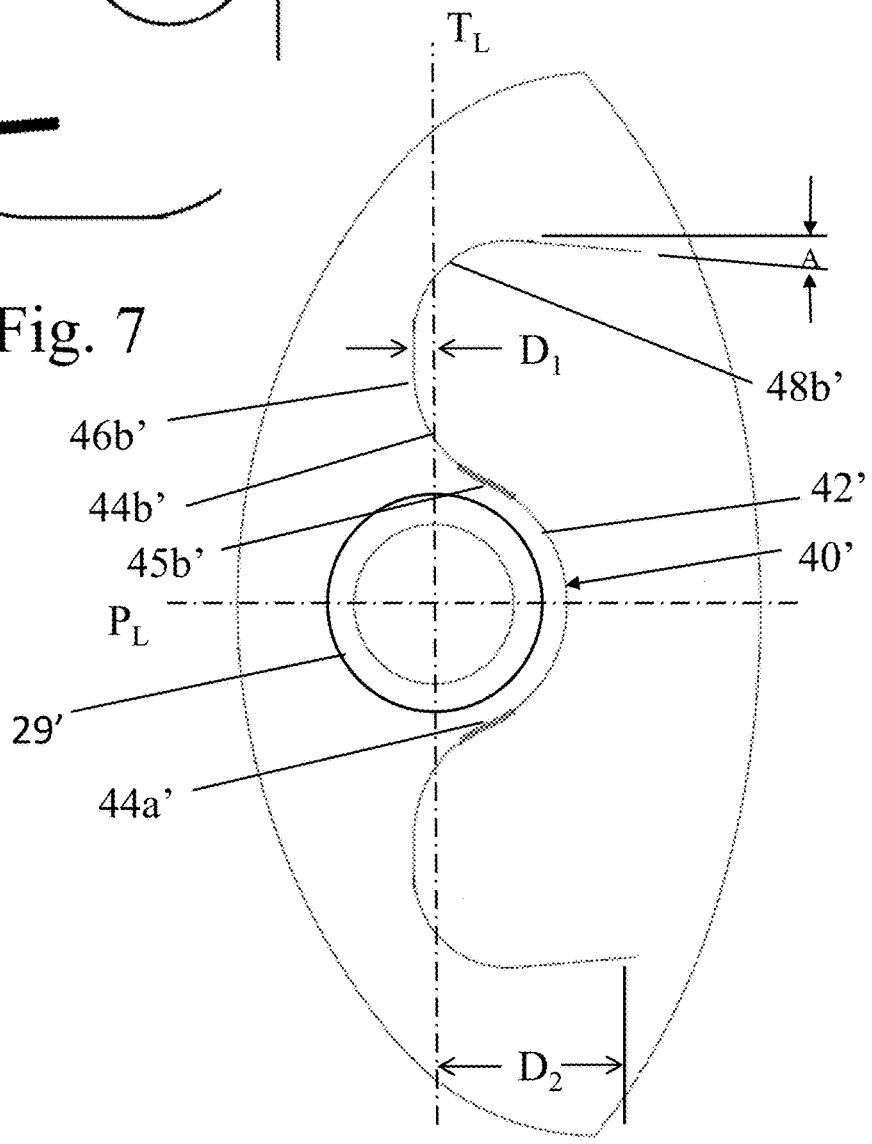
FIG. 8 is an enlarged view of a portion of the punch of FIG. 7.

Dimensional information of vent score 40 is provided with reference to the enlarged view of the tool 80 for forming the vent score in FIG. 8, in which element numbers with prime indications (i.e., 29', 40', 42', 44*a*', 44*b*', 45*b*', 46*b*', and 48*b*') identify portions of the tool 80, respectively, that form corresponding portions of the can end (i.e., button coin 29, vent score 40, central portion 42, transitions 44*a*, 44*b*, check slot 45*b*, lateral portion 46*b*, and transition 48*b*). Preferably, a portion of vent score 40 extends to (or approximately to) or forward of the transverse reference line $T_L$ to promote movement or hinging of the tab and rivet. For example, lateral portions 46*a* and 46*b* preferably extend forward of transverse line $T_L$ by a dimension $D_1$. Preferably, $D_1$ is positive and between 0 and 0.050 inches, and more preferably between 0.010 inches and 0.032 inches. In the embodiment shown in the figures, $D_1$ is approximately 0.021 inches.

Figure 2:
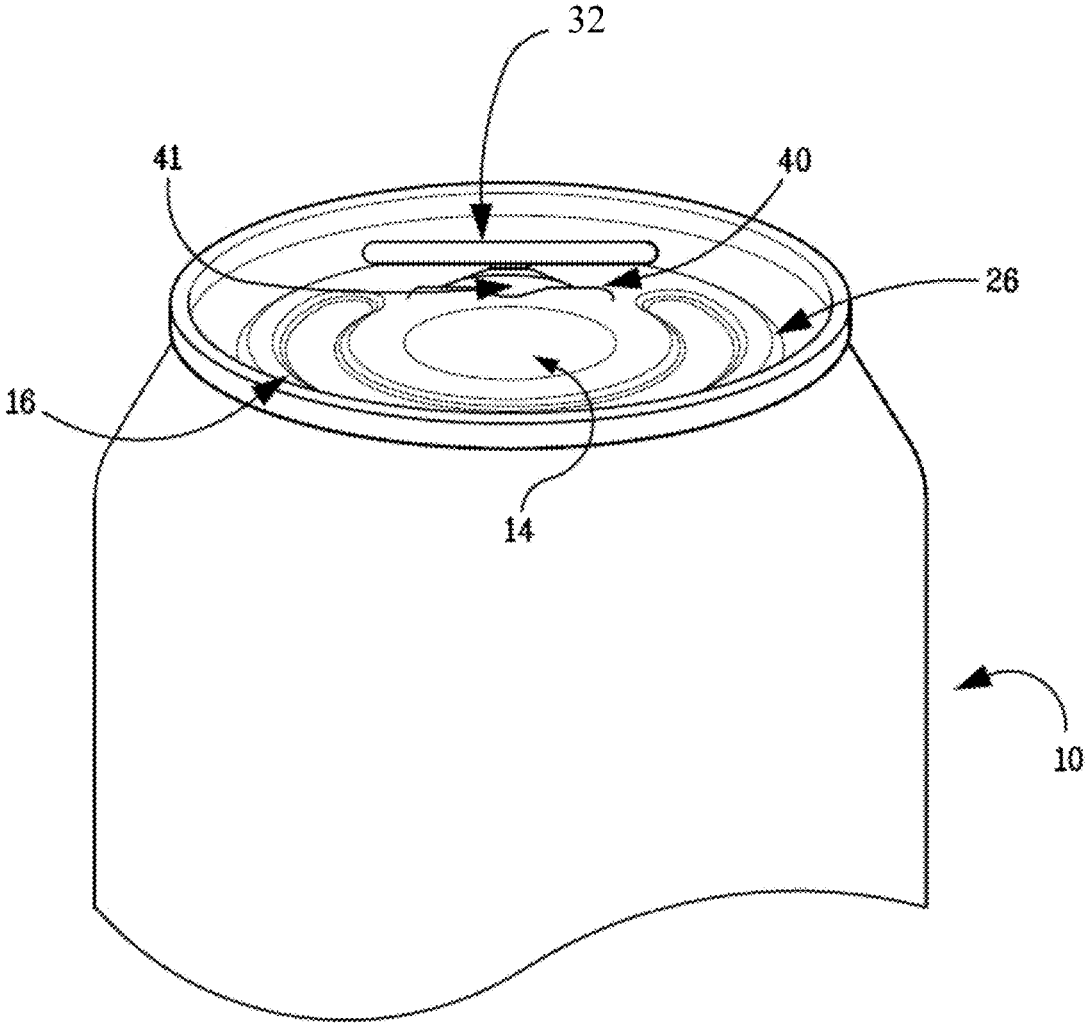
FIG. 2 a perspective view of the rear of the can showing the vent score ruptured and flap slightly displaced to form a vent opening.
Figure 3:
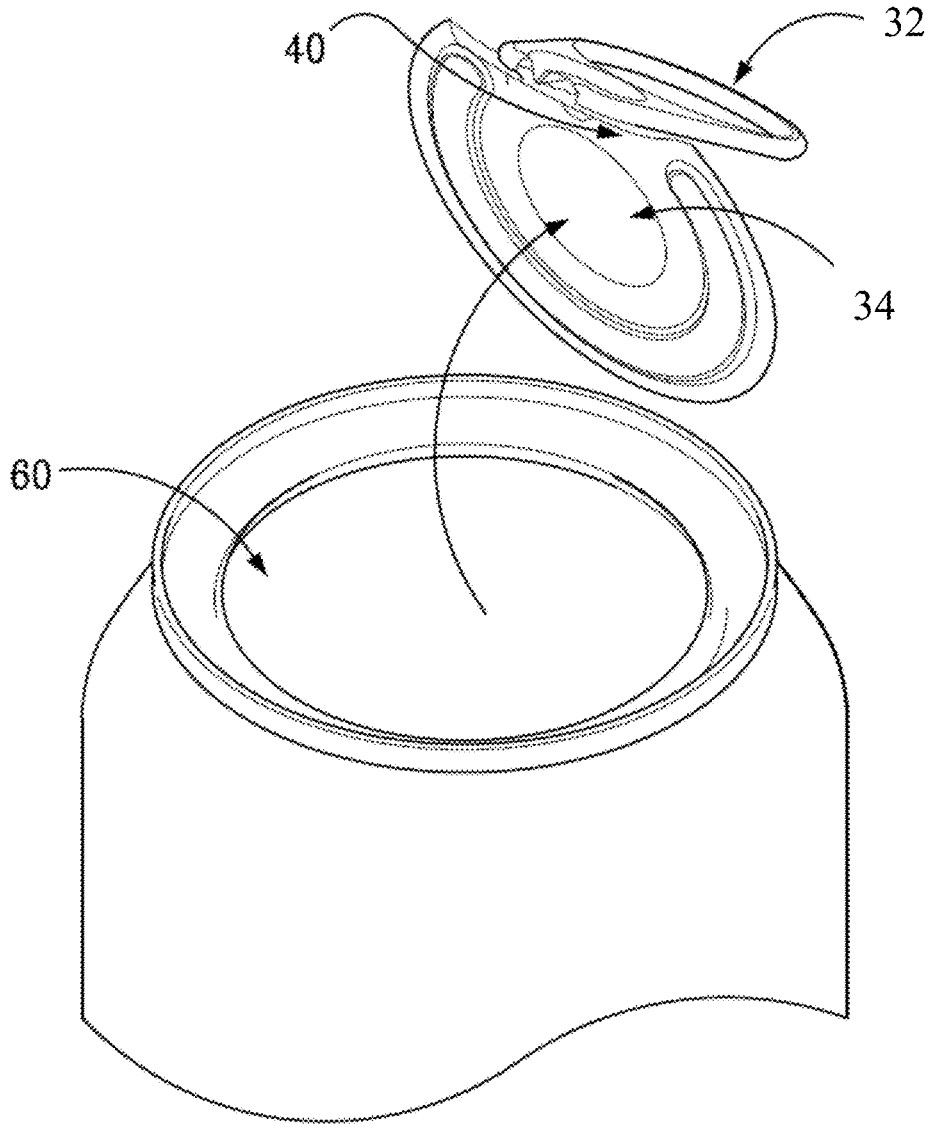
FIG. 3 is a perspective view of the beverage can of FIG. 1 showing the fully open position.

Side portions 50*a* and 50*b* are mutually spaced apart and extend rearwardly such that flap 56 creates sufficient area for venting. The vent opening is shown in FIG. 2 as reference numeral 41. In this regard, side portions 50*a* and 50*b* preferably extend rearwardly from transverse reference line $T_L$ by a distance $D_2$ that may be between 0.15 and 0.4 inches, and more preferably is between 0.2 and 0.3 inches. In the embodiment shown in the figures, $D_2$ is 0.217 inches. The ends of side portion terminations 52*a* and 52*b* are spaced apart by a distance of between 0.5 inches and 1.0 inches and preferably between 0.6 and 0.8 inches. In the embodiment shown, the distance between 52*a* and 52*b* is 0.746 inches.

Vent score sides may be curved or straight, and oriented at any angle A, measured relative to primary reference line $P_L$. For example, A may be approximately zero (that is, the vent score sides may be approximately parallel to primary reference line $P_L$), between +/−10 degrees, between +/−20 degrees, or between +/−30 degrees. In the embodiment shown in the figures, angle A is 5 degrees. Central portion 42 and lateral portions 46*a* and 46*b* may be shapes other than as shown in the figures.

Vent score 40 has an approximately uniform score residual dimension at least through score central portion 42, lateral portions 46*a* and 46*b*, and the front portion of score side portions 50*a* and 50*b*. Preferably, the score residual dimension for the score central portion 42, lateral portions 46*a* and 46*b*, and the front portion of score side portions 50*a* and 50*b* is between 0.0020 and 0.0045 inches. The check slots 45*a*, 45*b* have a score residual that is generally greater than that of score central portion 42, lateral portions 46*a* and 46*b*, and the front portion of score side portions 50*a* and 50*b*. Specifically, the score residual for the check slots may be greater by approximately 0.0040 inches such that the residual for the check slot is between 0.0060 and 0.0085 inches. The anvil against which tool 80 acts optionally has a step to control the residual dimension.

The present invention encompasses any shape of the vent score and any shape of the flap as broadly stated in the claims. The shape and dimensions provided above for vent score 40 and flap 56 are for illustration only and are not intended to be limiting. Each dimension provided above is approximate. As will be understood by persons familiar with can end engineering, the dimensions provided in this specification may be determined by various parameters for the particular application, including end material and thickness, internal pressure specifications, flap dimensions and area, and the like.

To describe the operation of can assembly 10 and to illustrate the corresponding inventive method, reference is made especially to FIGS. 1-3 and 6. Prior to opening, can assembly 10 has an internal pressure created when filed with a carbonated soft drink, beer, or the like. Scores 26 and 40 are intact and tab 32 is in its conventional rest portion of approximately flat against center panel 24 or approximately horizontal.

To open can assembly 10, a user lifts the heel end of tab 32, which moves the tab nose toward center panel 24 while deflecting the metal around the rivet until score central portion 42 ruptures, as shown in FIG. 2. The inventors surmise that by having the center portion spaced apart from the button coin 29 and/or being defined by a radius of at least 0.140 inches provides for a larger vent area earlier in the opening process. Specifically, prior art can ends have a radius of 1.131 inches and the slight adjustment of this radius such that the center portion is spaced apart from the button coin 29 results in an increase of the vent test rating by 8 psi. The inventors also surmise that spacing the central portion apart from the coined metal that forms the button coin 29 provides for a slower and more controlled rupture than if the central portion was positioned on the button coin 29.

Preferably, a portion of vent score 40 ruptures before any portion of first score 26 ruptures to achieve venting. Propagation of the vent score 40 is restrained as check slots 45*a*, 45*b* rupture. The thickened metal in the areas of the check slots 45*a*, 45*b* (if used) fracture more slowly than the remainder of the vent score 40. The rupture of vent score 40 then propagates through lateral portions 46*a* and 46*b* and rearward through score side portions 50*a* and 50*b* as flap 56 moves upwardly about hinge 54. In this regard, the can internal pressure actuates flap 56 to quickly produce a relatively large open area for can venting. Then, similar to the opening of conventional can ends, the user continues to actuate tab 32 until the main score 24 ruptures and removable panel 34 is detached so as to create aperture 60.

Figure 9:
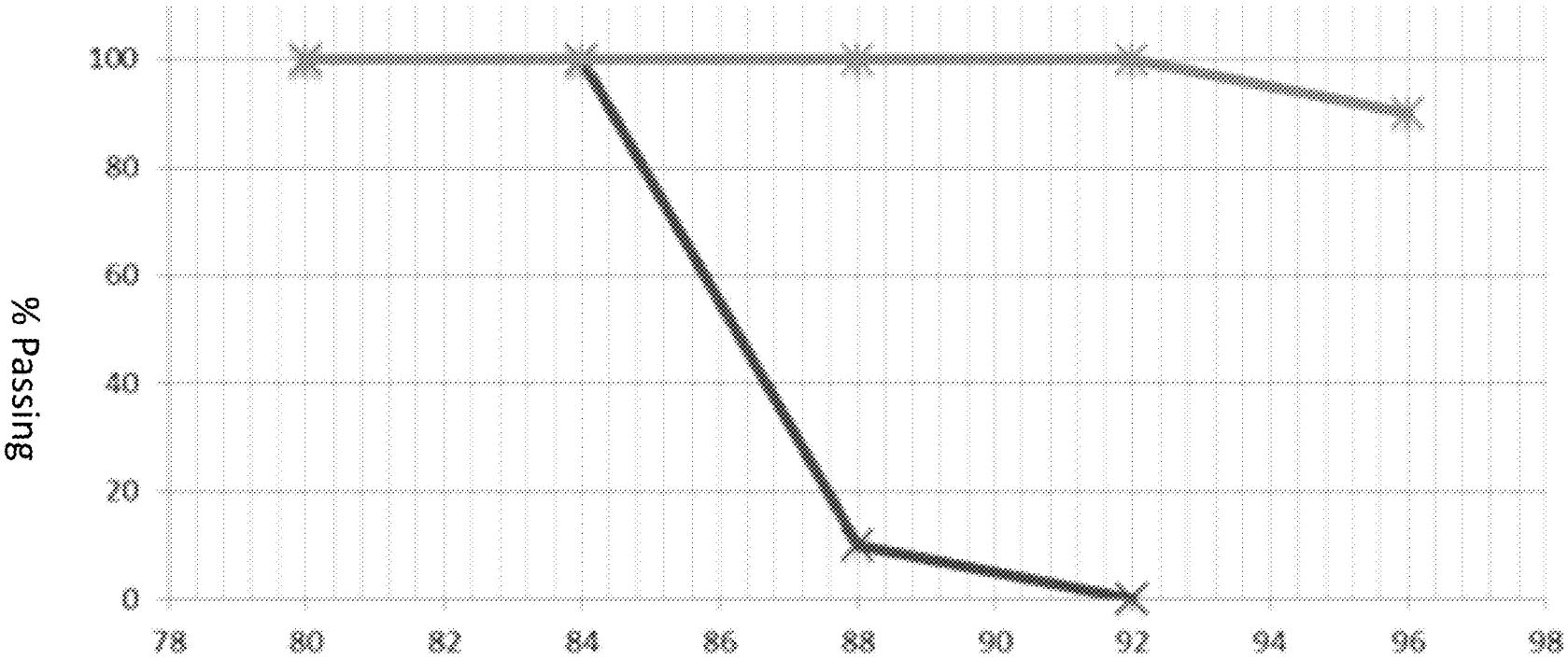
FIG. 9 is a table that outlines the difference between the prior art designs and the claimed configuration.

With reference to FIG. 9, the table shown outlines the dramatic difference between the prior art designs (the darker of the two lines) of the Ramsey and Fields applications and the claimed configuration (the lighter of the two lines). The x-axis represents pressure in psi and the y-axis is the pass rate (100% maximum). The increased vent test rating of the can end described herein provides for greater functionality over the prior art in relation to soft drink cans.

The embodiments shown in the figures and described above illustrate aspects of the present invention. The present invention is not limited to the particular embodiments shown in the figures, but encompasses structures and methods broader than the disclosure and limited only by the claims. For example, the present invention encompasses materials, chuck wall configuration, seam structure and processes, removable or hinged tear panel configuration, that are not shown in the figures unless limited in the claims.

What is claimed:

1. A full aperture can assembly having a vent test rating of at least 90 psi comprising: a can body; and a can end that is attached to the can body by a seam; the can end including: a center panel having an periphery and including a coined portion proximate a rivet;

a first score disposed proximate the periphery of the center panel, the first score defining a removable panel;

a tab, including a nose, mounted to the removable panel by the rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion spaced apart from the coined portion that intersects the longitudinal axis; (ii) a pair of check slots disposed on either side of the central portion; (iii) a pair of lateral portions that extend from the pair of check slots, respectively, and each include a segment that is approximately parallel to the lateral axis; and (iv) a pair of side portions that extend from the pair of lateral portions, respectively, away from the lateral axis.

2. The full aperture can assembly of claim 1 wherein the coined portion defines a button coin.

3. The full aperture can assembly of claim 2 wherein an average second score residual at the central portion is at least as thick as an average second score residual in the pair of lateral portions.

4. The full aperture can assembly of claim 1 wherein the central portion of the second score is at least partially defined by a radius extending from the center of the rivet, the radius having a value of 0.140 inches.

5. A full aperture unseamed can end having a vent test rating of at least 90 psi comprising:

a peripheral curl configured to be seamed together with a can body flange;

a wall extending inwardly and downwardly from the peripheral curl;

a center panel having an periphery and including a coined portion proximate a rivet;

a first score disposed proximate the periphery of the center panel, the first score defining a removable panel;

a tab, including a nose, mounted to the removable panel by the rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion spaced apart from the coined portion that intersects the longitudinal axis; (ii) a pair of check slots disposed on either side of the central portion; (iii) a pair of lateral portions that extend from the pair of check slots, respectively, and each include a segment that is approximately parallel to the lateral axis; and (iv) a pair of side portions that extend from the pair of lateral portions, respectively, away from the lateral axis.

6. The full aperture unseamed can end of claim 5 wherein the coined portion defines a button coin.

7. The full aperture unseamed can end of claim 6 wherein an average second score residual at the central portion is at least as thick as an average second score residual in the pair of lateral portions.

8. The full aperture unseamed can end of claim 5 wherein the central portion of the second score is at least partially defined by a radius extending from the center of the rivet, the radius having a value of 0.140 inches.

9. A full aperture can assembly having a vent test rating of at least 90 psi comprising: a can body; and a can end that is attached to the can body by a seam; the can end including: a center panel having an periphery;

a first score disposed proximate the periphery of the center panel, the first score defining a removable panel;

a tab, including a nose, mounted to the removable panel by a rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion defined by a radius extending from the center of the rivet, the radius having a value of at least 0.140 inches, the central portion intersecting the longitudinal axis; (ii) a pair of check slots disposed on either side of the central portion; (iii) a pair of lateral portions that extend from the pair of check slots, respectively, and each include a segment that is approximately parallel to the lateral axis; and (iv) a pair of side portions that extend from the pair of lateral portions, respectively, away from the lateral axis.

10. The full aperture can assembly of claim 9, wherein the removable panel further comprises a button coin and the rivet is disposed on the button coin, and wherein the central portion of the second score is spaced apart from the button coin.

11. The full aperture can assembly of claim 9 wherein an average second score residual at the central portion is at least as thick as an average second score residual in the pair of lateral portions.

12. A full aperture unseamed can end having a vent test rating of at least 90 psi comprising:

a peripheral curl configured to be seamed together with a can body flange;

a wall extending inwardly and downwardly from the peripheral curl; a center panel having a periphery;

a first score disposed proximate the periphery of the center panel, the first score defining a removable panel;

a tab, including a nose, mounted to the removable panel by a rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion defined by a radius extending from the center of the rivet, the radius having a value of at least 0.140 inches, the central portion intersecting the longitudinal axis; (ii) a pair of check slots disposed on either side of the central portion; (iii) a pair of lateral portions that extend from the pair of check slots, respectively, and each include a segment that is approximately parallel to the lateral axis; and (iv) a pair of side portions that extend from the pair of lateral portions, respectively, away from the lateral axis.

13. The full aperture unseamed can end of claim 12 wherein the removable panel further comprises a button coin and the rivet is disposed on the button coin, and wherein the central portion of the second score is spaced apart from the button coin.

14. The full aperture unseamed can end of claim 12 wherein an average second score residual at the central portion is at least as thick as an average second score residual in the pair of lateral portions.

15. A full aperture can assembly having a vent test rating of at least 90 psi comprising: a can body; and a can end that is attached to the can body by a seam; the can end including: a center panel having a periphery and including a coined portion proximate a rivet;

a first score disposed proximate the periphery of the center panel, the first score defining a removable panel;

a tab, including a nose, mounted to the removable panel by the rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion spaced apart from the coined portion that intersects the longitudinal axis; (ii) a pair of lateral portions that each include a segment that is approximately parallel to the lateral axis; and (iii) a pair of side portions that extend from the pair of lateral portions, respectively, away from the lateral axis.

16. The full aperture can assembly of claim 15 wherein the coined portion defines a button coin.

17. The full aperture can assembly of claim 16 wherein an average second score residual at the central portion is at least as thick as an average second score residual in the pair of lateral portions.

18. The full aperture can assembly of claim 15 wherein the central portion of the second score is at least partially defined by a radius extending from the center of the rivet, the radius having a value of 0.140 inches.

19. A full aperture unseamed can end having a vent test rating of at least 90 psi comprising: a peripheral curl configured to be seamed together with a can body flange;

a wall extending inwardly and downwardly from the peripheral curl;

a center panel having a periphery and including a coined portion proximate a rivet;

a first score disposed proximate the periphery of the center panel, the first score defining a removable panel;

a tab, including a nose, mounted to the removable panel by the rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion spaced apart from the coined portion that intersects the longitudinal axis; (ii) a pair of lateral portions that each include a segment that is approximately parallel to the lateral axis; and (iii) a pair of side portions that extend from the pair of lateral portions, respectively, away from the lateral axis.

20. The full aperture unseamed can end of claim 19 wherein the central portion of the second score is at least partially defined by a radius extending from the center of the rivet, the radius having a value of 0.140 inches.

21. The full aperture unseamed can end of claim 20 wherein an average second score residual at the central portion is as least as thick as an average second score residual in the pair of lateral portions.

22. A full aperture can assembly having a vent test rating of at least 90 psi comprising: a can body; and a can end that is attached to the can body by a seam; the can end including: a center panel having a periphery;

a first score disposed proximate the periphery of the center panel, the first score defining a removable panel;

a tab, including a nose, mounted to the removable panel by a rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion defined by a radius extending from the center of the rivet, the radius having a value of at least 0.140 inches, the central portion intersecting the longitudinal axis; (ii) a pair of lateral portions that each include a segment that is approximately parallel to the lateral axis; and (iii) a pair of side portions that extend from the pair of lateral portions, respectively, away from the lateral axis.

23. The full aperture can assembly of claim 22, wherein the removable panel further comprises a button coin and the rivet is disposed on the button coin, and wherein the central portion of the second score is spaced apart from the button coin.

24. The full aperture can assembly of claim 22 wherein an average second score residual at the central portion is at least as thick as an average second score residual in the pair of lateral portions.

25. An unseamed can end having a vent test rating of at least 90 psi comprising: a peripheral curl configured to be seamed together with a can body flange; a wall extending inwardly and downwardly from the peripheral curl; a center panel having a periphery;

a first score disposed proximate the periphery of the center panel, the first score defining a removable panel;

a tab, including a nose, mounted to the removable panel by a rivet such that the nose is disposed proximate the first score, the tab being elongate along a longitudinal axis that extends through a center of the rivet, the longitudinal axis being perpendicular to a lateral axis that also extends through the center of the rivet; and a second score disposed on the removable panel, the second score having (i) a central portion defined by a radius extending from the center of the rivet, the radius having a value of at least 0.140 inches, the central portion intersecting the longitudinal axis; (ii) a pair of lateral portions that each include a segment that is approximately parallel to the lateral axis; and (iii) a pair of side portions that extend from the pair of lateral portions, respectively, away from the lateral axis.

26. The unseamed can end of claim 25 wherein the removable panel further comprises a button coin and the rivet is disposed on the button coin, and wherein the central portion of the second score is spaced apart from the button coin.

27. The unseamed can end of claim 25 wherein an average second score residual at the central portion is at least as thick as an average second score residual in the pair of lateral portions.

* * * * *